US011026529B2

(12) United States Patent
Ferraro et al.

(10) Patent No.: US 11,026,529 B2
(45) Date of Patent: Jun. 8, 2021

(54) APPARATUS, SYSTEM, AND METHOD FOR A MOVABLE ASSEMBLY

(71) Applicant: Turquoise Harbor, LLC, Chicago, IL (US)

(72) Inventors: Christopher Ferraro, Chicago, IL (US); Gina Ferraro, Chicago, IL (US)

(73) Assignee: Turquoise Harbor, LLC, Chicago, IL (US)

( * ) Notice: Subject to any disclaimer, the term of this patent is extended or adjusted under 35 U.S.C. 154(b) by 126 days.

(21) Appl. No.: 16/408,614

(22) Filed: May 10, 2019

(65) Prior Publication Data

US 2020/0352374 A1 Nov. 12, 2020

(51) Int. Cl.
*A47G 19/22* (2006.01)
*A47G 23/02* (2006.01)

(52) U.S. Cl.
CPC ..... *A47G 23/0225* (2013.01); *A47G 19/2261* (2013.01); *A47G 2200/106* (2013.01)

(58) Field of Classification Search
CPC ..... A47G 23/0225; A47G 19/2261; A47G 2200/106
USPC ..... 220/630, 483, 574.1
See application file for complete search history.

(56) References Cited

U.S. PATENT DOCUMENTS 5,474,206 A * 12/1995 Herring, Sr. ..... A47J 43/0727 220/630
2012/0319313 A1* 12/2012 Davis ..... B65D 43/0202 261/119.1
2013/0098924 A1* 4/2013 Tate ..... A47G 19/2283 220/574
2013/0105492 A1* 5/2013 Melgoza ..... A47G 19/10 220/574
2016/0058220 A1* 3/2016 Dixon ..... A47G 19/2283 220/574
2016/0278557 A1* 9/2016 Esposito ..... A47G 23/0225
2018/0098653 A1* 4/2018 Pinchuk ..... A47B 77/02
2018/0255949 A1* 9/2018 Fritz ..... C03B 11/06
2019/0069703 A1* 3/2019 Boak ..... A01K 39/014
2019/0133351 A1* 5/2019 Carroll ..... A47G 19/22
2020/0170431 A1* 6/2020 Shafer ..... A47G 23/0225

FOREIGN PATENT DOCUMENTS

JP 03089484 A * 4/1991

* cited by examiner

*Primary Examiner* — J. Gregory Pickett
*Assistant Examiner* — Niki M Eloshway
(74) *Attorney, Agent, or Firm* — Ellenoff Grossman & Schole LLP; James M. Smedley; Alex Korona

(57) ABSTRACT

An apparatus is disclosed. The apparatus has a first member, a second member that is removably attachable to the first member, a first magnetic member attached to the first member, a second magnetic member attached to the second member, and at least one attachment portion disposed on the second member. When the first member is removably attached to the second member, a surface of the first member bears against a first surface of the second member. The at least one attachment portion is disposed on a second surface of the second member. The first surface and the second surface are disposed on opposite sides of the second member. The second member is removably attachable to the first member via magnetic attraction between the first and second magnetic members.

19 Claims, 6 Drawing Sheets

APPARATUS, SYSTEM, AND METHOD FOR A MOVABLE ASSEMBLY

TECHNICAL FIELD

The present disclosure generally relates to an apparatus, system, and method for providing an assembly, and more particularly to an apparatus, system, and method for providing a movable assembly.

BACKGROUND

Beverage containers and similar products are often used in activities such as boating and driving. Due to the motion involved in such activities, beverage containers often fall off of surfaces or out of beverage holders, usually leading to spills, loss, and/or unsafe conditions in trying to locate the fallen containers during activities such as driving and boating.

Conventional techniques for maintaining control of beverage containers and similar products typically involve permanent stationary holders located in vehicles. Such conventional techniques are often ergonomically ineffective, nonadjustable to match user's preferences, and/or ineffective in maintaining a beverage container or similar product in a desired location of a vehicle such as a car, truck, or boat when that vehicle is in motion.

The exemplary disclosed apparatus, system, and method are directed to overcoming one or more of the shortcomings set forth above and/or other deficiencies in existing technology.

SUMMARY OF THE DISCLOSURE

In one exemplary aspect, the present disclosure is directed to an apparatus. The apparatus includes a first member, a second member that is removably attachable to the first member, a first magnetic member attached to the first member, a second magnetic member attached to the second member, and at least one attachment portion disposed on the second member. When the first member is removably attached to the second member, a surface of the first member bears against a first surface of the second member. The at least one attachment portion is disposed on a second surface of the second member. The first surface and the second surface are disposed on opposite sides of the second member. The second member is removably attachable to the first member via magnetic attraction between the first and second magnetic members.

In another aspect, the present disclosure is directed to a method. The method includes providing a first member including a first magnetic member, and providing a second member including a second magnetic member and at least one attachment portion. The method also includes magnetically attaching the first member and the second member together by contacting a surface of the first member with a first surface of the second member, when the first member and the second member are magnetically attached, pressing the at least one attachment portion, which is disposed on a second surface of the second member that is opposite to the first surface, against an attachment surface, and forming a seal between the at least one attachment portion and the attachment surface based on pressing the at least one attachment portion against the attachment surface. A sealing force sealing the at least one attachment portion to the attachment surface is greater than a magnetic force attaching the first member and the second member together.

DETAILED DESCRIPTION AND INDUSTRIAL APPLICABILITY

Figure 1:
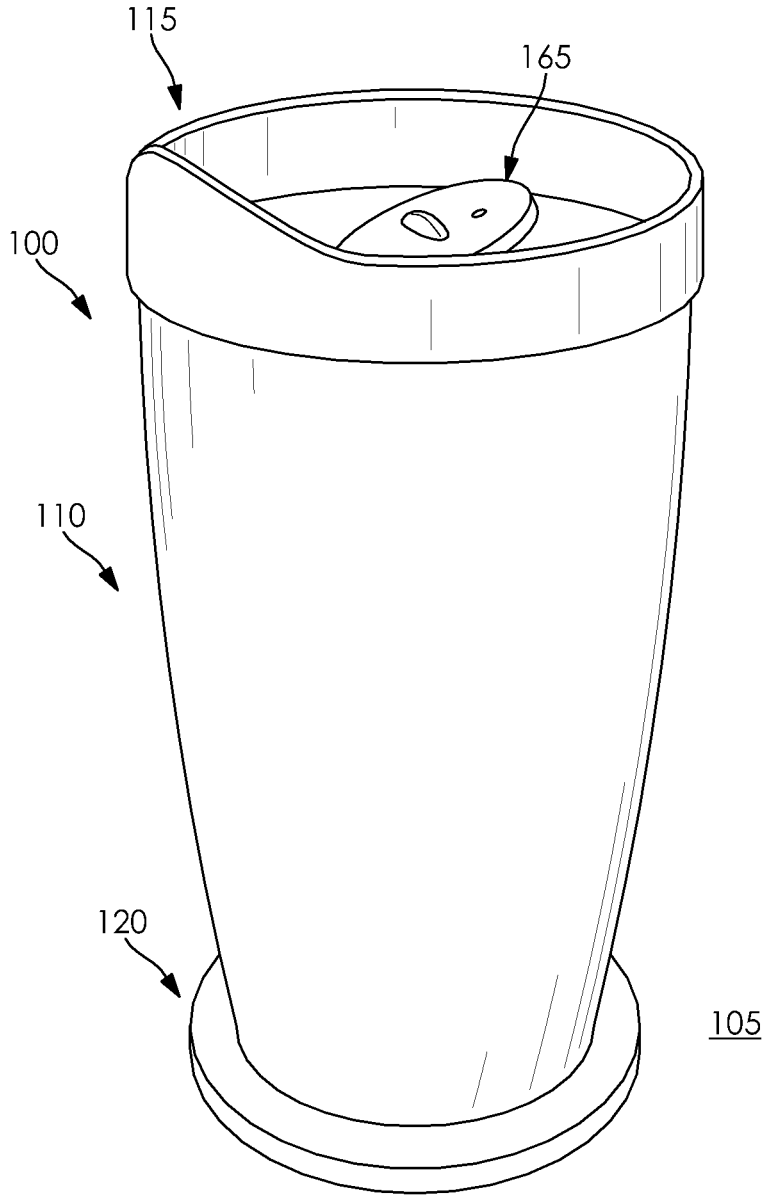
FIG. 1 is a perspective view of at least some exemplary embodiments of the present disclosure.
Figure 2:
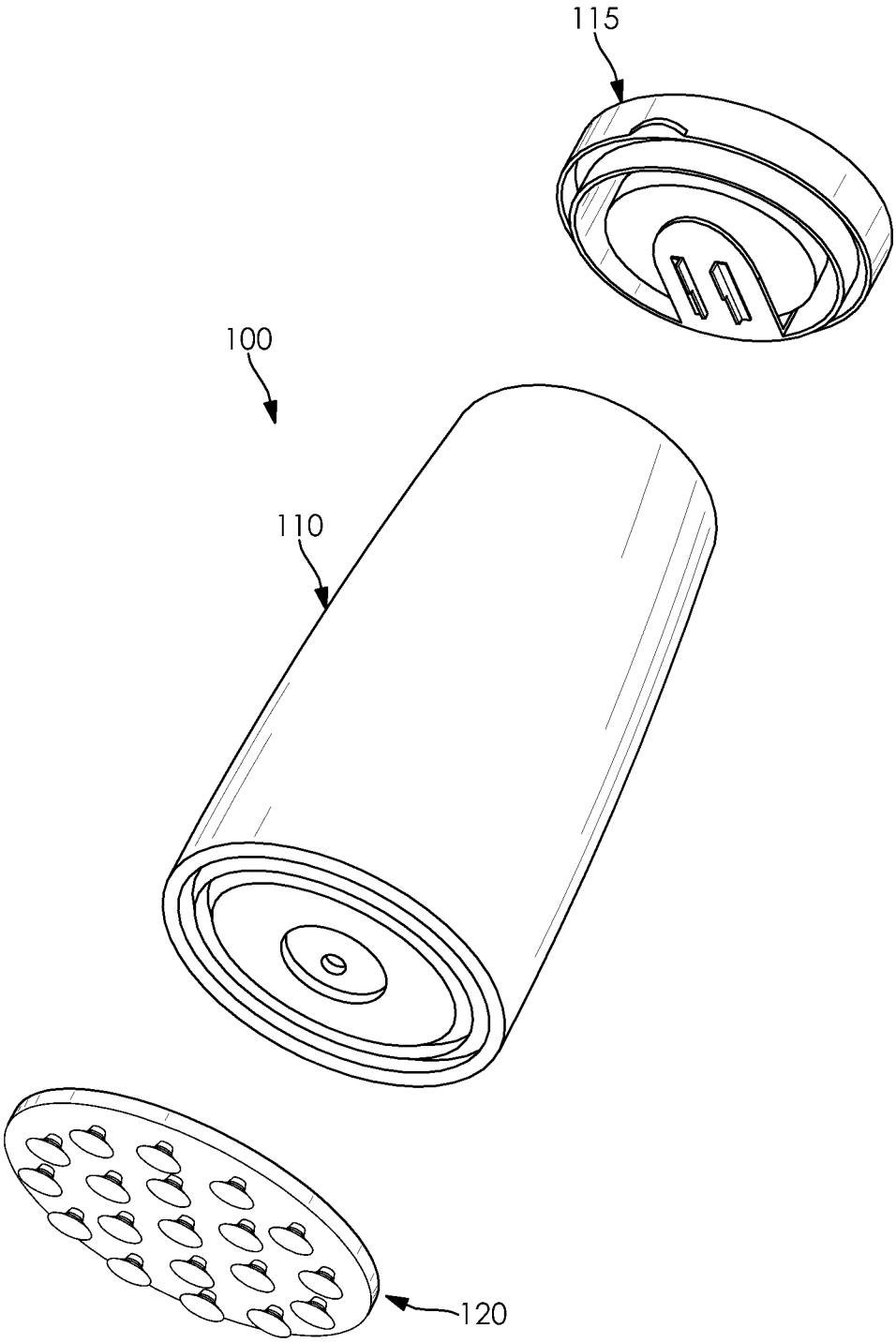
FIG. 2 is an exploded view of at least some exemplary embodiments of the present disclosure.

The exemplary disclosed apparatus, system, and method may be used in any suitable location or application. For example, the exemplary disclosed assembly (e.g., assembly 100 as illustrated in FIGS. 1-2) may be attached to an attachment surface (e.g., surface 105) that may be a surface of a vehicle or other desired surface. For example, surface 105 may be a surface of a waterborne vehicle (e.g., a boat), a ground vehicle (e.g., an RV, car, bus, or truck), or an air vehicle such as a fixed wing aircraft (e.g., a plane) or a rotary wing aircraft (e.g., helicopter). Also for example, surface 105 may be a surface of a residential location (e.g., countertop surface, tabletop surface, appliance surface located in a home, and/or any other suitable surface of a residential location), a commercial location (e.g., desk surface, tabletop surface, or other surface located in an office, retail location, and/or any other suitable surface of a commercial location), an industrial location (e.g., a surface of a factory), and/or any other desired surface in any desired location. In at least some exemplary embodiments, surface 105 may be a surface located in or used at restaurants, bars, sporting events, commercial aircraft, busses, trains, and/or large passenger or cruise ships. In at least some exemplary embodiments, surface 105 may be a smooth, solid surface located in any desired location. Surface 105 may be a surface of any suitable material such as, for example, granite, metal such as stainless steel, fiberglass, plastics such as molded plastics, and any other desired material surface. Surface 105 may be a substantially horizontal surface, a substantial vertical surface, a slanted surface relative to a floor or ground, and/or any other desired surface suitable for attachment to the exemplary disclosed assembly.

Components of the exemplary disclosed apparatus may be formed from any suitable material for providing a removably attachable assembly. For example, components of the exemplary disclosed assembly may be formed from polymer material, structural metal (e.g., structural steel), co-polymer material, thermoplastic and thermosetting polymers, resin-containing material, polyethylene, polystyrene, polypropylene, epoxy resins, phenolic resins, Acrylanitrile Butadiene Styrene (ABS), Polycarbonate (PC), Mix of ABS and PC, Acetal (POM), Acetate, Acrylic (PMMA), Liquid Crystal Polymer (LCP), Mylar, Polyamid-Nylon, Polyamid-Nylon 6, Polyamid-Nylon 11, Polybutylene Terephthalate (PBT), Polycarbonate (PC), Polyetherimide (PEI), Polyethylene (PE), Low Density PE (LDPE), High Density PE (HDPE), Ultra High Molecular Weight PE (UHMW PE), Polyethylene Terephthalate (PET), PolPolypropylene (PP), Polyphthalamide (PPA), Polyphenylenesulfide (PPS), Polystyrene (PS), High Impact Polystyrene (HIPS), Polysulfone (PSU), Polyurethane (PU), Polyvinyl Chloride (PVC), Chlorinated Polyvinyl chloride (CPVC), Polyvinylidenefluoride (PVDF), Styrene Acrylonitrile (SAN), Teflon TFE, Thermoplastic Elastomer (TPE), Thermoplastic Polyurethane (TPU), and/or Engineered Thermoplastic Polyurethane (ETPU), or any suitable combination thereof.

The exemplary disclosed assembly may be any suitable assembly that may be removably attachable to surface 105. For example as illustrated in FIGS. 1-4, assembly 100 may be a container such as a hot or cold beverage container. As illustrated for example in FIGS. 5 and 6 and described further below, the exemplary disclosed assembly may include a mobile phone holder, a utility basket, a serving tray, and/or any other suitable assembly for use in vehicles, residential locations, commercial locations, and/or industrial locations.

Returning to FIGS. 1 and 2 and in at least some exemplary embodiments, the exemplary disclosed apparatus, system, and method may include assembly 100. Assembly 100 may be removably attached to a surface such as surface 105 as described for example below. Assembly 100 may include a member 110, to which a cover member 115 and a base member 120 may be removably attached.

Figure 3:
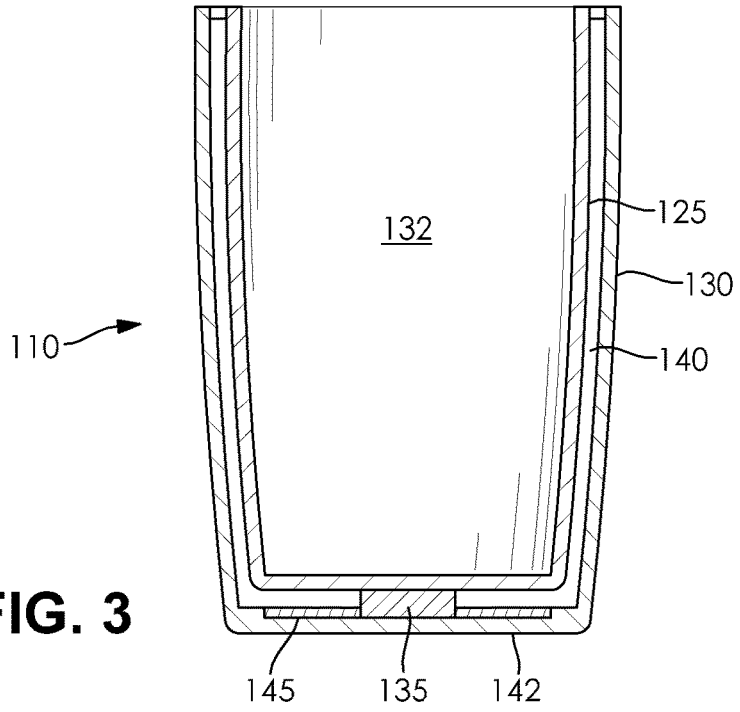
FIG. 3 is a sectional view of an exemplary member of at least some exemplary embodiments of the present disclosure.
Figure 4:
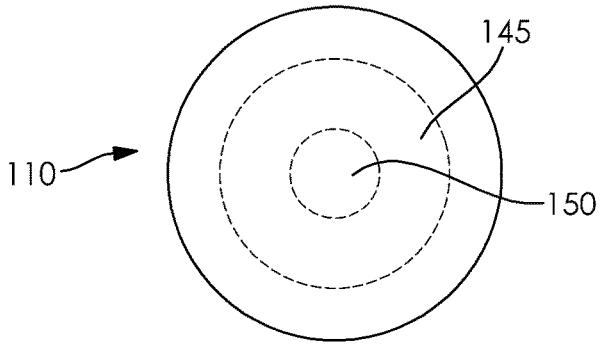
FIG. 4 is a bottom view of an exemplary member of at least some exemplary embodiments of the present disclosure.

As illustrated in FIGS. 3 and 4, member 110 may be any suitable container for holding a beverage, food, materials (e.g., chemicals for use in any desired application), and/or any other liquid, gaseous, and/or solid material. For example, member 110 may be a beverage container such as a cup, glass, mug, or tumbler. Member 110 may include one or more portions (e.g., walls) 125 and/or 130 that may form a container such as a container (e.g., an insulated container) for holding a beverage in a cavity 132 of member 110. For example, one or more portions 125 and 130 may be separated by a spacer member 135. A cavity 140 (e.g., gap) may be formed between portions 125 and 130. Cavity 140 may be an empty cavity or partially or substantially filled with any suitable insulating material. Portions 125 and 130 may provide double-walled insulation of contents of member 110. Member 110 may have substantially smooth exterior surfaces and/or surfaces having protrusions, recesses, and other similar portions for facilitating a secure grip by users and/or other desired feature. Member 110 may include a surface 142 that may be a bottom surface of member 110. Surface 142 may be a smooth, solid, and/or substantially flat surface having substantially no protrusions, recesses, and/or similar portions.

Member 110 may also include a magnetic member 145. One or more (e.g., a plurality of) magnetic members 145 may be disposed partially in, substantially entirely within, on an exterior surface of, or in any other desired position on and/or in member 110. For example, magnetic member 145 may be disposed partially or substantially within portion 130 (e.g., a bottom portion of portion 130). Magnetic member 145 may have any desired shape or configuration. In at least some exemplary embodiments, magnetic member 145 may be an elongated and/or substantially flat member. Magnetic member 145 may also have a prism shape, a coiled shape, a cubic shape, a spherical shape, or any other desired shape. In at least some exemplary embodiments, magnetic member 145 may include an aperture 150 disposed for example at a central portion of magnetic member 145. For example, spacer member 135 may be received within aperture 150 to help attach magnetic member 145 to member 110. Magnetic member 145 may be disposed parallel and near to (e.g., a few millimeters or one or more sixteenths or eighths of an inch from) surface 142. For example, magnetic member 145 may be an elongated member that is disposed within a surface portion of member 110 adjacent to or close to surface 142 (e.g., just beneath a surface of a portion of member 110). In at least some exemplary embodiments, magnetic member 145 may be disposed within member 110 close to and substantially parallel to surface 142 as illustrated in FIG. 3.

Magnetic member 145 may be any suitable magnetic member. Magnetic member 145 may be any suitable permanent magnet including any suitable alloy. Magnetic member 145 may be any suitable magnet for generating a relatively strong magnetic field such as, for example, a magnetic field (e.g., flux density) greater than 1.0 Teslas, between about 1.0 and about 1.5 Teslas, greater than 1.4 Teslas, between about 1.0 and about 2.0 Teslas (e.g., or more), or any other suitable magnetic field strength. For example, magnetic member 145 may be any suitable rare earth magnet. Magnetic member 145 may include neodymium, iron, boron, samarium, cobalt, praseodymium, cerium, gadolinium, copper, and/or zirconium material. In at least some exemplary embodiments, magnetic member 145 may be a samarium-cobalt magnet or a neodymium magnet. Magnetic member 145 may be a powerful NdFeB rare earth magnet. For example, magnetic member 145 may be any suitable grade of Neodymium rare earth magnet such as N35, N40, N42, N45, N48, N50, or N52 grade. Magnetic member 145 may be coated with any suitable coating such as nickel, zinc, tin, copper, epoxy, silver, and/or gold to prevent rusting of magnetic materials. For example, magnetic member 145 may include coated Neodymium, Iron, and Boron material (e.g., and/or coated samarium, cobalt, praseodymium, cerium, and/or gadolinium material). Magnetic member 145 may also be any other suitable type of magnet such as a ferrite magnet, a ceramic magnet, an electromagnet, or an Alnico magnet. Magnetic member 145 may be a permanent magnet or a temporary magnet. Magnetic member 145 may be of any suitable size, shape, and type. In at least some exemplary embodiments, magnetic member 145 may have a diameter of about 50 mm, a thickness of about 2 mm, and/or an inner size of about 20 mm (e.g., or any other suitable dimensions). Additionally in at least some exemplary embodiments, magnetic member

145 may have a magnetic force of N40, 1800-2000 GS (e.g., or any other suitable magnetic force).

Figure 5:
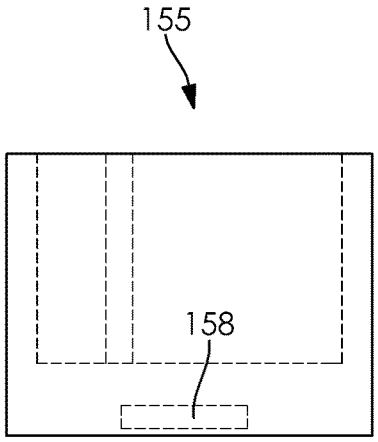
FIG. 5 is a side view of at least some exemplary embodiments of the present disclosure.
Figure 6:
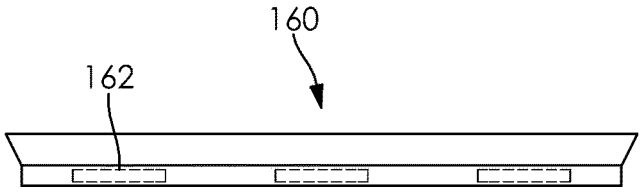
FIG. 6 is a side view of at least some exemplary embodiments of the present disclosure.

In addition to the exemplary member 110 illustrated in FIGS. 3 and 4, the exemplary disclosed member may be any other suitable type of member or assembly that may be utilized with the exemplary disclosed base member (e.g., base member 120). For example, the exemplary disclosed member may be a member 155 (e.g., a container, a utility basket, a mobile phone holder, an electronic device, or any other suitable member or assembly) as illustrated in FIG. 5 or a member 160 (e.g., a serving tray, an electronic device such as a tablet, or any other suitable elongated member or assembly) as illustrated in FIG. 6. Member 155 may also for example include a base such as a magnetized silicone rubber base that may be attached via any suitable technique (e.g., via permanent adhesive, press-fit connection, or rubber boot) to an existing component (e.g., any desired component) so that this component may be used with the exemplary disclosed system. Member 155 may include one or more magnetic members 158 that may be generally similar to magnetic member 145, and member 160 may include one or more magnetic members 162 that may be generally similar to magnetic member 145. Members 155 and 160 may be used with assembly 100 similarly to member 110 as described for example herein.

Returning to FIGS. 1 and 2, cover member 115 may be any suitable member for removably or fixedly attaching to member 110. For example, cover member 115 may be a beverage cover or lid that may be removably attached to member 110 (e.g., that is a beverage container). Cover member 115 may also be any suitable member for attaching to (e.g., covering) any suitable exemplary disclosed member as described for example herein (e.g., member 110, member 155, or member 160). Cover member 115 may include a movable or adjustable assembly 165 that may selectively allow or prevent access to an interior of the exemplary disclosed member. For example, assembly 165 may include a member that is movable (e.g., slidable) to selectively cover and expose an aperture. For example, assembly 165 may be moved to allow a user to drink or otherwise access contents of the exemplary disclosed member (e.g., member 110, member 155, or member 160). Cover member 115 may include any suitable recesses, protrusions, and/or other suitable portions to be removably or fixedly attached to the exemplary disclosed member (e.g., member 110, member 155, or member 160) and/or to provide any other desired feature (e.g., a spout for drinking, an ergonomic grip, and/or any other feature).

Figure 7:
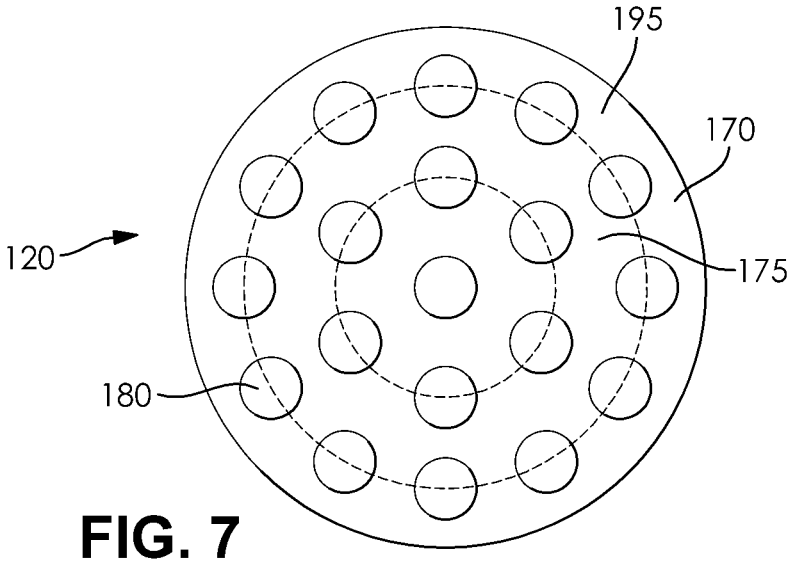
FIG. 7 is a bottom view of an exemplary base member of at least some exemplary embodiments of the present disclosure.
Figure 8:
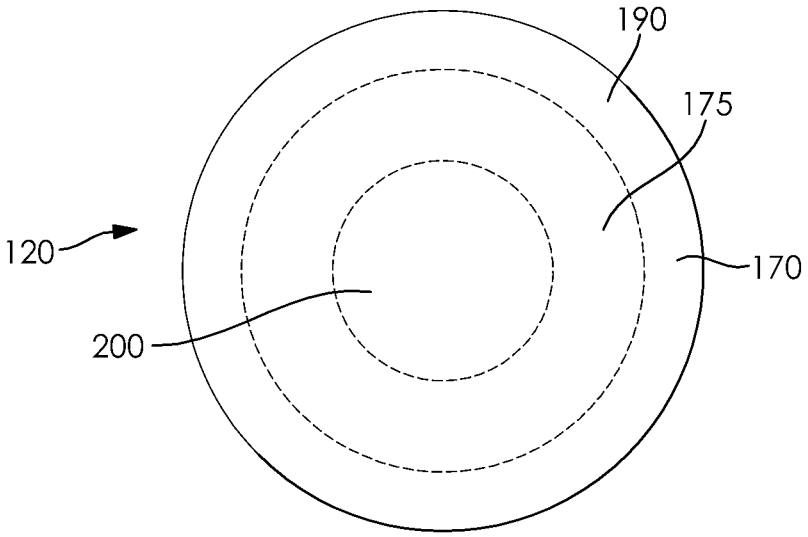
FIG. 8 is a top view of an exemplary base member of at least some exemplary embodiments of the present disclosure.
Figure 9:
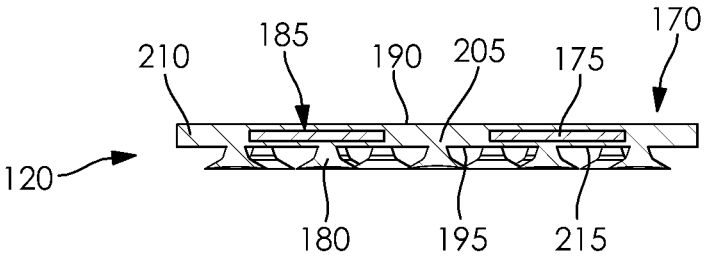
FIG. 9 is a sectional view of an exemplary base member of at least some exemplary embodiments of the present disclosure.

FIGS. 7-9 illustrate an embodiment of the exemplary disclosed base member. FIG. 7 illustrates a bottom view of base member 120, FIG. 8 illustrates a top view of base member 120, and FIG. 9 illustrates a sectional view of base member 120. Base member 120 may be any suitable member for being removably attached to surface 105 and/or member 110 (e.g., and/or any other exemplary disclosed member, e.g., member 155 or member 160). Base member 120 may include a body member 170, a magnetic member 175, and one or more attachment portions 180. Body member 170 may house and/or be attached to magnetic member 175 and one or more attachment portions 180 as described for example below.

Body member 170 may be any suitable member for housing and/or being attached to magnetic member 175 and attachment portions 180. Body member 170 may include one or more cavities 185 configured to partially or substantially entirely house (e.g., hold in a tight-fit manner) one or more magnetic members 175. Body member 170 may have any desired shape such as, for example, an elongated shape (e.g., flat elliptical or circular, rectangular, polygonal, or any other desired elongated shape), a prism shape, an elliptical (e.g., spherical) shape, and/or any other desired configuration.

Body member 170 may include a surface 190 that may be a top surface of body member 170 and a surface 195 that may be bottom surface of body member 170. Surfaces 190 and 195 may each be a smooth, solid, and/or substantially flat surface having substantially no protrusions recesses, and/or similar portions. In at least some exemplary embodiments, surface 190 may be configured to bear flush against (e.g., be fully in contact when pressed against) some or substantially all of surface 142 of member 110.

Body member 170 may be formed from any suitable material for housing magnetic member 175 and being attached to attachment portions 180. Body member 170 may be formed from a rubberized material. Body member 170 may be formed from a durable material (e.g., a highly durable material). For example, body member 170 may include natural or synthetic rubber, elastomeric material, and/or any other suitable flexible material. Body member 170 may be formed from silicone rubber material. Body member 170 may be a magnetized material. In at least some exemplary embodiments, body member 170 may be formed from silicone rubber such as a highly durable magnetized silicone rubber. Also for example, body member 170 may be formed from material such as nylon material, neoprene, chloroprene, latex, vinyl material, flexible Polyethylene (PE), Polyvinyl Chloride (PVC), Polypropylene (PP), thermoplastic elastomers, and/or any other suitable type of textile, fabric, or material having flexible and/or elastic properties.

One or more (e.g., a plurality of) magnetic members 175 may be disposed partially in, substantially entirely within, on an exterior surface of, or in any other desired position on and/or in body member 170. Magnetic member 175 may be disposed parallel and near to both surface 190 and 195. For example, magnetic member 175 may be an elongated member that is disposed within a central portion of body member 170, between and parallel to both surface 190 and surface 195 as illustrated in FIG. 9.

Magnetic member 175 may be generally similar to magnetic member 145, and may have a similar configuration and be formed from similar materials to magnetic member 145 as described for example above. For example, magnetic member 175 may have an aperture 200 that may be similar to aperture 150 of magnetic member 145. When body member 170 is formed from a flexible material, an interior portion 205 of body member 170 disposed at aperture 200 and an exterior portion 210 of body member 170 that may extend past (e.g., hang over or form an overhang from) magnetic member 175 may move flexibly relative to portions 215 of body member 170 disposed at (e.g., above or below) magnetic member 175. Interior portion 205 and exterior portion 210 may thereby be flexibly moved (e.g., moved up or down during use of assembly 100 by a user) relative to relatively stiffer portions 215 disposed above or below magnetic member 175.

In at least some exemplary embodiments, magnetic member 145 of member 110 and magnetic member 175 of base member 120 may be similar magnets that may act on each other and other material of assembly 100 based on their respective magnetic fields. For example, magnetic member 145 and magnetic member 175 may cause components of assembly 100 to move relative to each other as described for example below. For example, magnetic members 145 and 175 may be configured to have magnetic poles and magnetic fields to magnetically affect each other and other components of assembly 100 as described for example below. In at least some exemplary embodiments, magnetic members 145 and 175 may be configured so that magnetic members 145 and 175 attract each other (e.g., and other portions of assembly 100) when surface 142 of member 110 is facing surface 190 of base member 120 (e.g., and magnetic members 145 and 175 may repel each other when surface 142 of member 110 is facing surface 195 of base member 120).

One or more attachment portions 180 may be attached to base member 120 (e.g., at surface 195) by any suitable technique such as via adhesive, heat fusion or welding, mechanical connection, molding, and/or any other suitable technique. One or more attachment portions 180 may also be formed integrally with body member 170 of base member 120. One or more attachment portions 180 may be formed from similar material as body member 170. Base member 120 may include any suitable number of attachment portions 180 such as one, a few, or a dozen or more (e.g., up to 20, 30, or more) attachment portions 180. Attachment portions 180 may be formed in any desired configuration on surface 195 such as at regular or random intervals, concentric ellipses, circles, or other concentric shapes, or any other desired pattern or configuration. Attachment portion 180 may be any suitable member or device for forming a seal or other suitable attachment with a surface such as surface 105. For example, attachment portion 180 may be any suitable flexible member that may form a seal against surface 105 in order to attach base member 180 to surface 105 via attachment portion 180. Attachment portion 180 may be any suitable flexible member for deforming when pressed against surface 105 to expel air disposed in a cavity of attachment portion 180 to create a vacuum seal against surface 105 (e.g., which may create a force to hold attachment portion 180 and base member 120 to surface 105). Attachment portion 180 may be either dry or wet when pressed against surface 105 to form a desired seal. In at least some exemplary embodiments, attachment portion 180 may be a suction cup such as a flexible suction cup. Attachment portion 180 may also be an adhesive connector, a hook and loop connector, a magnetic connector (e.g., similar to the exemplary magnetic members described herein), or any other suitable attachment component.

In at least some exemplary embodiments, the exemplary disclosed apparatus, system, and method may be a movable, magnetic, and secure base and cup system that may be used on any smooth, solid surface. The exemplary disclosed apparatus, system, and method may serve as a portable holder (e.g., cup holder) that may provide a holder (e.g., cup holder) in any desired location. The exemplary disclosed apparatus, system, and method may also be used with existing holding systems (e.g., existing cup holders such as shallow cup holders). The exemplary disclosed apparatus, system, and method may resist motion on vehicles on land, water, and air, and may prevent spills and accidents by providing a secure and stable mounting system.

In at least some exemplary embodiments, the exemplary disclosed apparatus may include a first member (e.g., member 110, member 155, or member 160). a second member (e.g., base member 120) that is removably attachable to the first member, a first magnetic member (e.g., magnetic member 145) attached to the first member, a second magnetic member (e.g., magnetic member 175) attached to the second member, and at least one attachment portion (e.g., attachment portion 180) disposed on the second member. When the first member is removably attached to the second member, a surface (e.g., surface 142) of the first member may bear against a first surface (e.g., surface 190) of the second member. The at least one attachment portion may be disposed on a second surface (e.g., surface 195) of the second member. The first surface and the second surface may be disposed on opposite sides of the second member. The second member may be removably attachable to the first member via magnetic attraction between the first and second magnetic members. The first and second magnetic members may each be rare earth magnets. The first and second magnetic members may each generate magnetic fields of between 1.0 and 2.0 Teslas. The first and second magnetic members may each be NdFeB rare earth magnets. The second member may include rubberized material. The second member may be a magnetized silicone rubber member. The at least one attachment portion may be a plurality of suction cups. The second magnetic member may be attached to the second member by being entirely disposed within an interior portion of the second member. The first and second magnetic members may be configured to attract each other when the surface of the first member faces the first surface of the second member and may be configured to repel each other when the surface of the first member faces the second surface of the second member. The first member may be a beverage container and the second member may be an elongated base member.

In at least some exemplary embodiments, the exemplary disclosed apparatus may include a beverage container (e.g., member 110), a beverage container base (e.g., base member 120) that is removably attachable to the beverage container, a first rare earth magnet (e.g., magnetic member 145) attached to the beverage container, a second rare earth magnet (e.g., magnetic member 175) attached to the beverage container base, and a plurality of suction cups (e.g., attachment portions 180) disposed on the beverage container base. When the beverage container is removably attached to the beverage container base, a surface (e.g., surface 142) of the beverage container bears against a first surface (e.g., surface 190) of the beverage container base. The plurality of suction cups may be disposed on a second surface (e.g., surface 195) of the beverage container base. The first surface and the second surface may be disposed on opposite sides of the beverage container base. The beverage container base may be removably attachable to the beverage container via magnetic attraction between the first and second rare earth magnets. The first and second rare earth magnets may each be NdFeB rare earth magnets. The beverage container base may be a magnetized silicone rubber member.

The exemplary disclosed apparatus, system, and method may be used in any suitable application for maintaining (e.g., in a desired position), accessing, moving, and manipulating any desired assembly in any suitable location. The exemplary disclosed apparatus, system, and method may be used in any application involving motion or travel, such as for example a waterborne vehicle (e.g., a boat), a ground vehicle (e.g., an RV, car, bus, or truck), or an air vehicle such as a fixed wing aircraft (e.g., a plane) or a rotary wing aircraft (e.g., helicopter). The exemplary disclosed apparatus, system, and method may be used in any application involving positioning, moving, and/or replacing an assembly (e.g., a beverage container or other suitable product) in any suitable application such as a residential (e.g., home) setting, a commercial setting (e.g., a business or in retail locations), an industrial application (e.g., in a factory), or any other desired location. In at least some exemplary embodiments, the exemplary disclosed apparatus, system, and method may be used in applications in restaurants, bars, sporting events, commercial aircraft, busses, trains, and/or large passenger or cruise ships.

Figure 10:
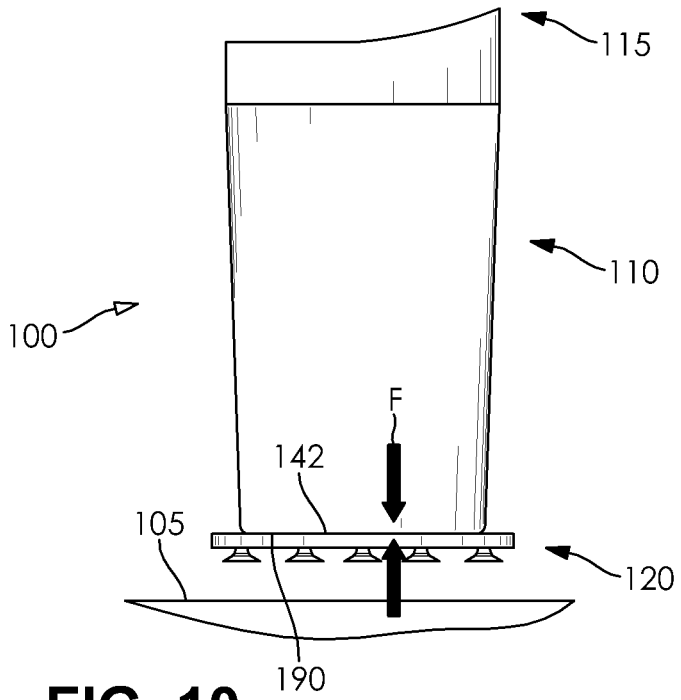
FIG. 10 is a schematic view of at least some exemplary embodiments of the present disclosure.

An exemplary operation of the exemplary disclosed apparatus, system, and method will now be described. As illustrated in FIG. 10, assembly 100 may be configured with cover member 115 removably attached to member 110. Surface 142 of member 110 may face surface 190 of base member 120 so that magnetic members 145 and 175 attract each other (e.g., via a force F). Based on the attraction of magnetic members 145 and 175 (e.g., via force F), member 110 may abut and be magnetically attached to base member 120 (e.g., surface 142 of member 110 may be pressed so that it is bearing flush against surface 190 of base member 120 based on the magnetic field and forces, e.g., force F, applied between magnetic members 145 and 175).

Figure 11:
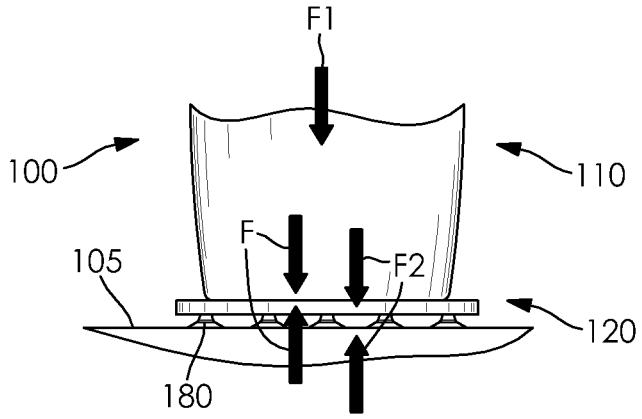
FIG. 11 is a schematic view of at least some exemplary embodiments of the present disclosure.

As illustrated in FIG. 11, assembly 100 may be pushed against surface 105 based on the application of a force F1 (e.g., applied by a user of assembly 100). Based on application of force F1, one or more attachment portions 180 may attach base member 120 to surface 105. For example when attachment portion 180 is a vacuum-creating flexible member such as a suction cup, force F1 may cause air to be expelled from a cavity of attachment portion 180 to form a vacuum, which may provide a vacuum or sealing force F2. For example, force F2 may be cumulatively created by a sealing of a plurality of attachment portions 180 to surface 105. Force F2 may thereby attach base member 120 to surface 105 via one or more attachment portions 180 (e.g., via a sealing or vacuum force, adhesion, mechanical connection, and/or any other suitable technique).

Figure 12:
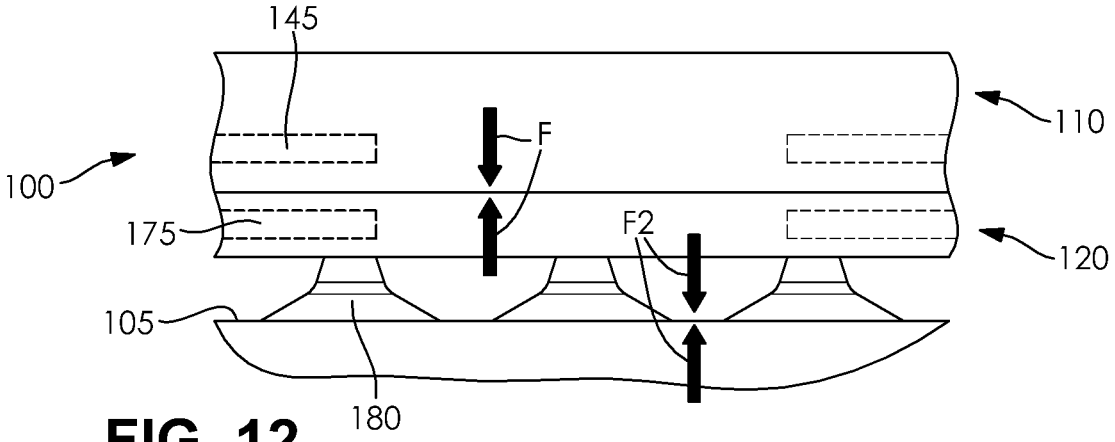
FIG. 12 is a schematic view of at least some exemplary embodiments of the present disclosure.
Figure 13:
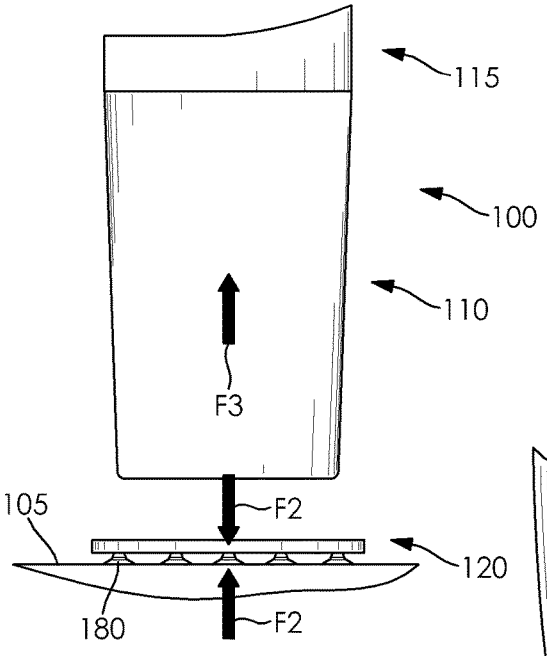
FIG. 13 is a schematic view of at least some exemplary embodiments of the present disclosure.

As illustrated in FIGS. 11-13, member 110 may be separated (e.g., by a user) from base member 120 while base member 120 remains attached to surface 105 based on force F2 (e.g., applied based on an operation of one or more attachment portions 180). Force F2 applied by attachment portions 180 may be greater than force F applied by magnetic members 145 and 175. A force F3 may be applied (e.g., applied by a user) to remove member 110 from base member 120. As force F3 increases in magnitude to remove member 110 from base member 120, force F3 may exceed a magnitude of force F, but may not exceed a magnitude of force F2. That is, as member 110 is removed from base member 120 via force F3, force F may be less than force F3, and force F3 may be less than force F2 (e.g., F<F3<F2). Force F3 may thereby remove member 110 from base member 120 while force F2 maintains an attachment of base member 120 to surface 105 (e.g., via attachment portions 180).

For example when a user desired to securely attach assembly 100 to surface 105 when assembly 100 is not in use, assembly 100 may be in the exemplary configuration illustrated in FIG. 12 (e.g., following an initial attachment as illustrated in FIGS. 10 and 11 as described for example above). When in the exemplary configuration of FIG. 12, assembly 100 may remain securely attached to surface 105 when subjected to motion such as vehicular motion (e.g., motion due to the exemplary applications such as use with vehicles as described for example herein). Base member 120 may also be attached to surface 105 via forces F1 and F2 without member 110 being attached. When the user would like to utilize member 110 while leaving base member 120 attached to surface 105, that user may remove member 110 from base member 120 and then replace member 110 on base member 120 as many times as desired as described for example above and as illustrated in FIGS. 13 and 14.

Magnetic members 145 and 175 may be configured to guide a user in correctly attaching member 110 and base member 120. For example, when surface 142 of member 110 faces surface 190 of base member 120 (e.g., in an exemplary desired configuration of use of assembly 100), magnetic members 145 and 175 may attract each other (e.g., via a force F) so that member 110 is attached to base member 120. Also for example, when surface 142 of member 110 faces surface 195 of base member 120 (e.g., in an exemplary undesired configuration of use of assembly 100), magnetic members 145 and 175 may repel each other (e.g., via a magnetic force that may be equal to and opposite to force F) so that member 110 is repelled from base member 120. A user may thereby be prevented from using assembly 100 in an undesired way based on an operation of magnetic members 145 and 175.

Figure 14:
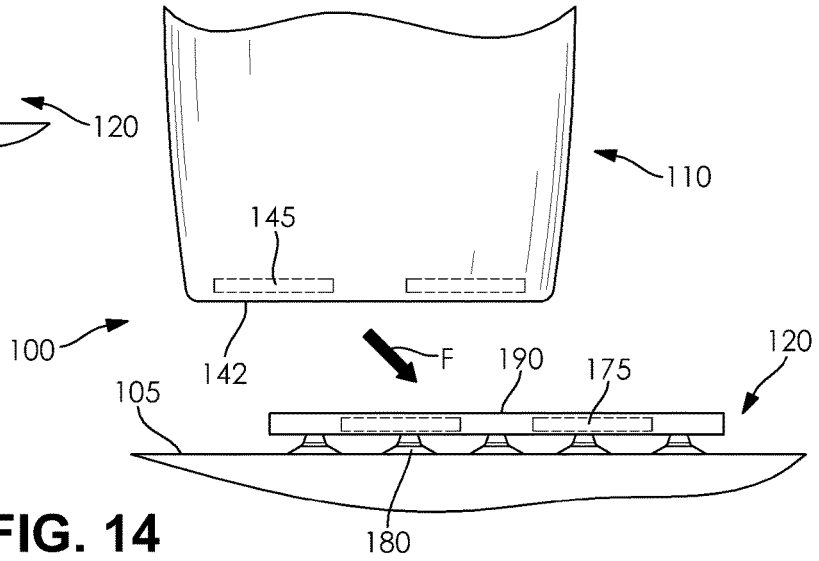
FIG. 14 is a schematic view of at least some exemplary embodiments of the present disclosure.
Figure 15:
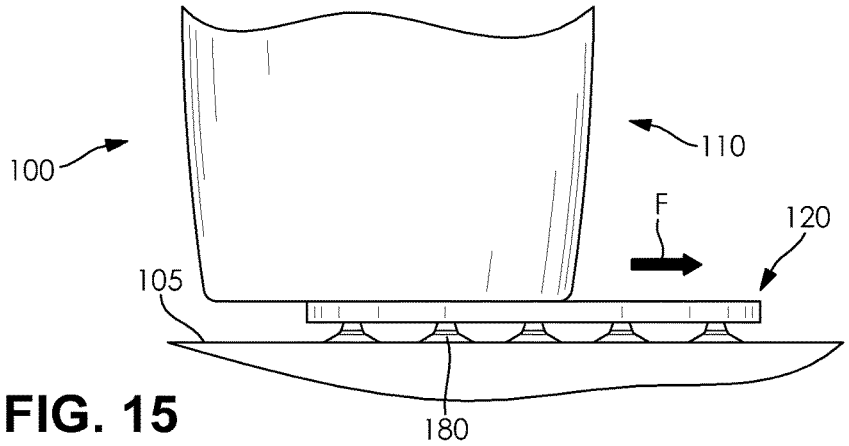
FIG. 15 is a schematic view of at least some exemplary embodiments of the present disclosure.

As illustrated in FIGS. 14 and 15, force F may also serve to urge or move member 110 to a desired position on base member 120. For example when a user moves surface 142 of member 110 near surface 190 of base member 120 (e.g., when magnetic members 145 and 175 are close enough to have their respective magnetic fields affect each other), force F may urge magnetic members 145 and 175 toward each other (e.g., based on magnetic attraction). For example, when a user may be operating a vehicle or otherwise unable to give full attention to the relative location of member 110 and base member 120, force F may urge or move member 110 toward and/or into a desired location on base member 120 (e.g., for example a center or other desired location). For example, force F may urge member 110 to be centered on base member 120 (e.g., so that magnetic members 145 and 175 are aligned as illustrated in FIG. 12). This may be helpful for when a user reaches to utilize assembly 100 while not looking at assembly 100 (e.g., reaching down to take a drink of a beverage from member 110 and then replacing member 110 back onto base member 120).

Also for example as illustrated in FIG. 15, force F may serve as a sliding force that may move member 110 to a center (e.g., or other desired location) on base member 120. For example, magnetic members 145 and 175 may be configured to produce force F that may be greater than a frictional resistance based on sliding surfaces 142 and 190 against each other. Accordingly, force F may cause member 110 to move to a desired location on base member 120 when a user places a portion of surface 142 of member 110 against a portion of surface 190 of base member 120.

A user may remove base member 120 from surface 105 for example by applying a force greater than force F2 directly to base member 120 (e.g., pulling base member 120 off of surface 105). The user may replace base member 120 as desired on any desired surface and continue to use assembly 100 as described for example above.

In at least some exemplary embodiments, the exemplary disclosed method may include providing a first member (e.g., member 110, member 155, or member 160) including a first magnetic member (e.g., magnetic member 145), providing a second member (e.g., base member 120) including a second magnetic member (e.g., magnetic member 175) and at least one attachment portion (e.g., attachment portion 180), magnetically attaching the first member and the second member together by contacting a surface (e.g., surface 142) of the first member with a first surface (e.g., surface 190) of the second member, and when the first member and the second member are magnetically attached, pressing the at least one attachment portion, which is disposed on a second surface (e.g., surface 195) of the second member that is opposite to the first surface, against an attachment surface (e.g., surface 105). The exemplary disclosed method may also include forming a seal between the at least one attachment portion and the attachment surface based on pressing the at least one attachment portion against the attachment surface. A sealing force sealing the at least one attachment portion to the attachment surface may be greater than a magnetic force attaching the first member and the second member together. The seal may be selected from the group consisting of a vacuum seal and an adhesive seal. The exemplary disclosed method may also include centering the surface of the first member on the first surface of the second member using the magnetic force. The exemplary disclosed method may further include sliding the surface of the first member on the first surface of the second member using the magnetic force. The attachment surface may be a surface of a vehicle. The at least one attachment portion may be a plurality of suction cups. The first and second magnetic members may each be rare earth magnets.

The exemplary disclosed apparatus, system, and method may provide an efficient and effective technique for maintaining (e.g., in a desired position), accessing, moving, and manipulating any desired assembly in a desired location such as, for example, a driver or passenger area of a vehicle. For example, the exemplary disclosed apparatus, system, and method may provide a technique for allowing users to place an assembly such as a beverage container in any suitable location of a driver or passenger area of a moving vehicle such as a car, truck, RV, or boat. The exemplary disclosed apparatus, system, and method may provide a ergonomically effective technique for maintaining, utilizing, and replacing a product in a desired location in a moving vehicle in a manner that feels comfortable and natural to a user.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as described herein-above may be used. Many suitable materials are known and available and can be selected and mixed depending on desired strength and flexibility, preferred manufacturing method and particular use, as will be apparent to a person of ordinary skill in the art.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. An apparatus, comprising:

a first member;

a second member that is removably attachable to the first member;

a first magnetic member attached to the first member;

a second magnetic member attached to the second member; and at least one attachment portion disposed on the second member;

wherein when the first member is removably attached to the second member, a surface of the first member bears against a first surface of the second member;

wherein the at least one attachment portion is disposed on a second surface of the second member;

wherein the first surface and the second surface are disposed on opposite sides of the second member;

wherein a center portion of the surface of the first member, at which the first magnetic member is disposed, slides across the first surface of the second member and aligns with a center portion of the first surface of the second member, at which the second magnetic member is disposed, based on a magnetic attraction between the first and second magnetic members when the first member is removably attached to the second member; and wherein the second member includes rubberized material forming a cavity that completely surrounds the second magnetic member, the rubberized material forming a flexible portion that extends beyond a perimeter of the second magnetic member.

2. The apparatus of claim 1, wherein the first and second magnetic members are each rare earth magnets having an identical size and shape as each other.

3. The apparatus of claim 1, wherein the first and second magnetic members each generate an identical magnetic field of between 1.0 and 2.0 Teslas.

4. The apparatus of claim 1, wherein the second member is a magnetized silicone rubber member that is integrally formed with the at least one attachment portion that is a plurality of suction cups formed from magnetized silicone rubber material.

5. The apparatus of claim 1, wherein the at least one attachment portion is a plurality of suction cups that are evenly distributed across the second surface of the second member.

6. The apparatus of claim 1, wherein:

the first magnetic member is permanently attached to the first member; and the second magnetic member is permanently attached to the second member by being entirely disposed within an interior portion of the second member.

7. The apparatus of claim 1, wherein the first member is a beverage container and the second member is an elongated base member.

8. The apparatus of claim 1, wherein the first member is a container including a container cavity formed by a double-walled wall portion including a first wall portion and a second wall portion, the first and second wall portions spaced apart by a cavity.

9. The apparatus of claim 8, wherein the first magnetic member includes an aperture, which is received by a spacer member that is partially disposed in the cavity between the first and second wall portions, the first magnetic member also being partially disposed in a recess of the second wall portion that forms the surface of the first member.

10. A method, comprising:

providing a first member including a first magnetic member;

providing a second member including a second magnetic member and at least one attachment portion;

magnetically attaching the first member and the second member together by contacting a surface of the first member with a first surface of the second member;

pressing the at least one attachment portion, which is disposed on a second surface of the second member that is opposite to the first surface, against an attachment surface; and forming a seal between the at least one attachment portion and the attachment surface based on pressing the at least one attachment portion against the attachment surface;

wherein a sealing force sealing the at least one attachment portion to the attachment surface is greater than a magnetic force attaching the first member and the second member together; and centering a center portion of the surface of the first member with a center portion of the first surface of the second member using the magnetic force;

wherein the first and second magnetic members are each rare earth magnets that have an identical size and shape to each other and that each include an aperture disposed at a center portion of each of the first and second magnetic members.

11. The method of claim 10, wherein the seal is selected from the group consisting of a vacuum seal and an adhesive seal.

12. The method of claim 10, further comprising sliding the surface of the first member on the first surface of the second member using the magnetic force.

13. The method of claim 10, wherein the attachment surface is a surface of a vehicle.

14. The method of claim 10, wherein the at least one attachment portion is a plurality of suction cups.

15. The apparatus of claim 10, wherein the first and second magnetic members are each NdFeB rare earth magnets.

16. The apparatus of claim 10, wherein the second member is a magnetized silicone rubber member.

17. The method of claim 10, wherein centering the center portion of the surface of the first member with the center portion of the first surface of the second member using the magnetic force includes centering the first member with the second member, and centering the first magnetic member with the second magnetic member.

18. An apparatus, comprising:

a first member;

a second member that is removably attachable to the first member;

a first magnetic member attached to the first member;

a second magnetic member attached to the second member; and at least one attachment portion disposed on the second member;

wherein when the first member is removably attached to the second member, a surface of the first member bears against a first surface of the second member;

wherein the at least one attachment portion is disposed on a second surface of the second member;

wherein the first surface and the second surface are disposed on opposite sides of the second member;

wherein a center portion of the surface of the first member, at which the first magnetic member is disposed, slides across the first surface of the second member and aligns with a center portion of the first surface of the second member, at which the second magnetic member is disposed, based on a magnetic attraction between the first and second magnetic members when the first member is removably attached to the second member; and wherein the second member is a magnetized silicone rubber member that is integrally formed with the at least one attachment portion that is a plurality of suction cups formed from magnetized silicone rubber material.

19. An apparatus, comprising:

a first member;

a second member that is removably attachable to the first member;

a first magnetic member attached to the first member;

a second magnetic member attached to the second member; and at least one attachment portion disposed on the second member;

wherein when the first member is removably attached to the second member, a surface of the first member bears against a first surface of the second member;

wherein the at least one attachment portion is disposed on a second surface of the second member;

wherein the first surface and the second surface are disposed on opposite sides of the second member;

wherein a center portion of the surface of the first member, at which the first magnetic member is disposed, slides across the first surface of the second member and aligns with a center portion of the first surface of the second member, at which the second magnetic member is disposed, based on a magnetic attraction between the first and second magnetic members when the first member is removably attached to the second member;

wherein the first member is a container including a container cavity formed by a double-walled wall portion including a first wall portion and a second wall portion, the first and second wall portions spaced apart by a cavity; and wherein the first magnetic member includes an aperture, which is received by a spacer member that is partially disposed in the cavity between the first and second wall portions, the first magnetic member also being partially disposed in a recess of the second wall portion that forms the surface of the first member.

* * * * *